United States Patent [19]

Liu

[11] 4,076,180

[45] Feb. 28, 1978

[54] FOOD SHREDDING AND DICING MACHINE

[76] Inventor: William Y. Liu, 286 Clinton Ave., Brooklyn, N.Y. 11205

[21] Appl. No.: 665,169

[22] Filed: Mar. 9, 1976

[51] Int. Cl.[2] ..... B02C 18/10; B02C 18/18

[52] U.S. Cl. ..... 241/154; 241/282.1; 241/282.2; 241/285 A

[58] Field of Search ..... 241/92, 152 R, 152 A, 241/199.9, 199.12, 277, 282.1, 282.2, 285 A, 285 B

[56] References Cited

U.S. PATENT DOCUMENTS

| | | | |
|---|---|---|---|
| 1,158,198 | 10/1915 | Franke | 241/277 X |
| 2,780,417 | 2/1957 | Harris | 241/152 R |
| 2,856,976 | 10/1958 | MacDougall | 241/92 |
| 3,032,087 | 5/1962 | Rodwick | 241/92 |
| 3,809,325 | 5/1974 | Marrie | 241/282.1 X |

*Primary Examiner*—Roy Lake
*Assistant Examiner*—Howard N. Goldberg
*Attorney, Agent, or Firm*—Stephen Wyden

[57] ABSTRACT

A threading and dicing machine having a motor mounted on an upper surface with an entry port in the upper surface of cylindrical shape carrying food pieces down to a control disk mounted on a shaft with a cutting blade mounted on the shaft above the control disk to slice the food pieces, an exit port carries the sliced pieces to a receiving container; a set of thin vertical cutting blades can be mounted to the shaft through the control disk to produce shredded pieces of the food piece; the control disk can be raised and lowered and the spacings between the thin vertical blades can be narrowed or widened, so that the sizes of the slices or shreds can be increased and decreased.

8 Claims, 7 Drawing Figures

FIG. 2
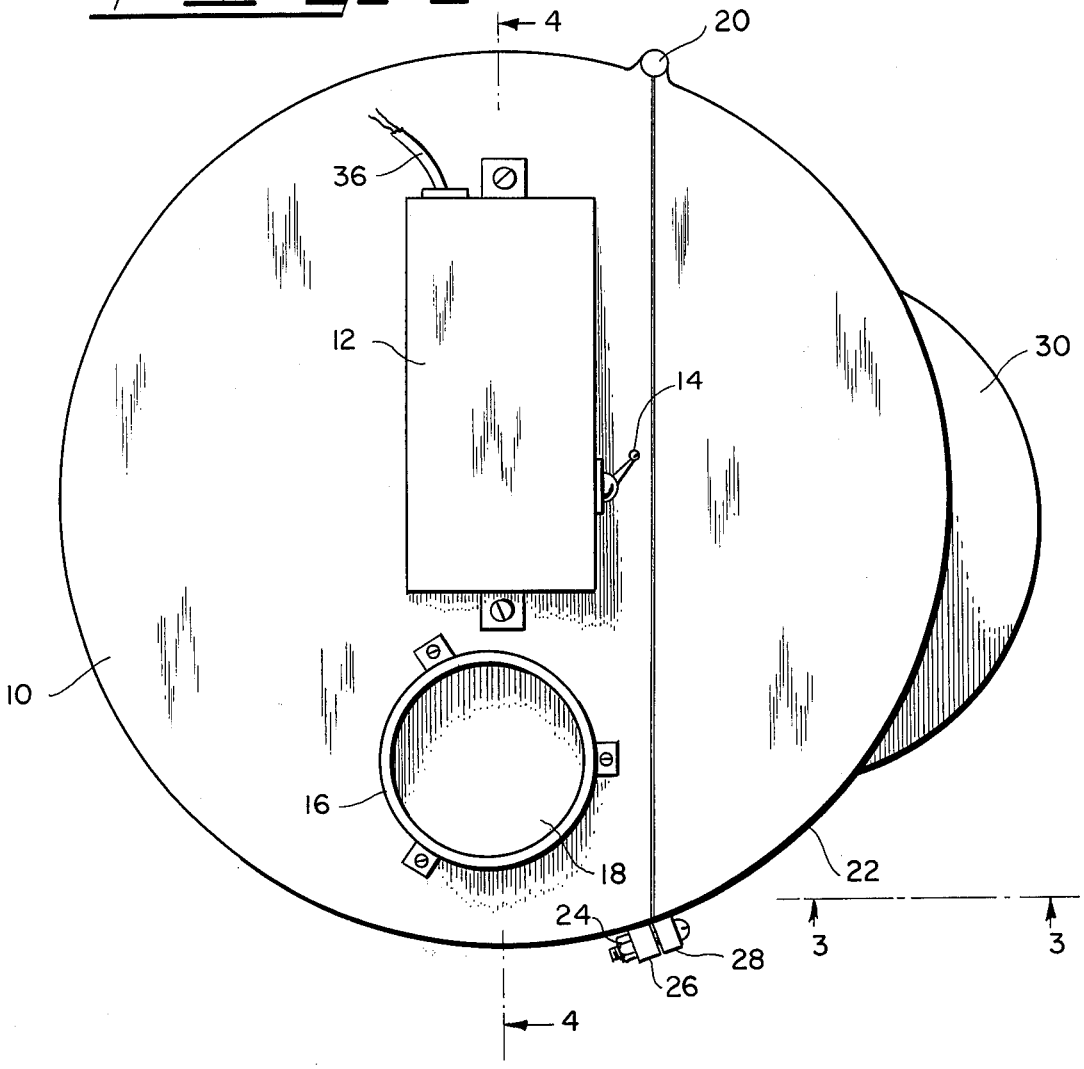
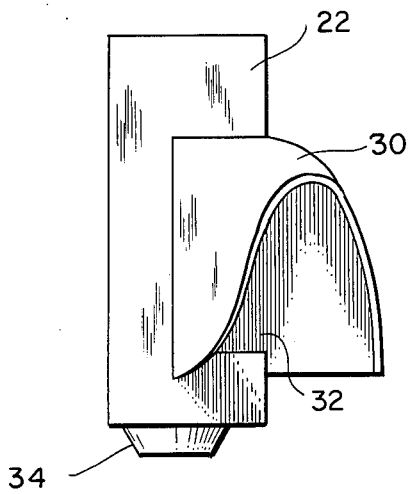
FIG. 3

FOOD SHREDDING AND DICING MACHINE

I have invented a new and novel food shredding, slicing, and onion dicing machine. My device will automatically shred or dice vegetables that are fed into it. Furthermore, because of the centrifugal action of an internal rotating control disc the cut or diced particles of food are automatically discharged from the machine.

It is an object of my invention to provide a machine that is adjustable to cut slices of food items of a predetermined thickness and to dice food items into predetermined size pieces. It is a further object of my invention to provide a means for cutting the vegetables which centrifugally discharges the sliced or diced particles through an opening flange in the side wall of the machine.

It is a still further object of my invention to provide a machine which may conveniently be used in restaurants where large quantities of slicing and dicing are required especially restaurants of the chinese food type.

My invention can be understood in view of the accompanying figures.

FIG. 2 is a top view of the shredding and dicing machine.

FIG. 3 is a partial side view of the shredding and dicing machine taken along the plane 3—3 of FIG. 2.

Figure 1:
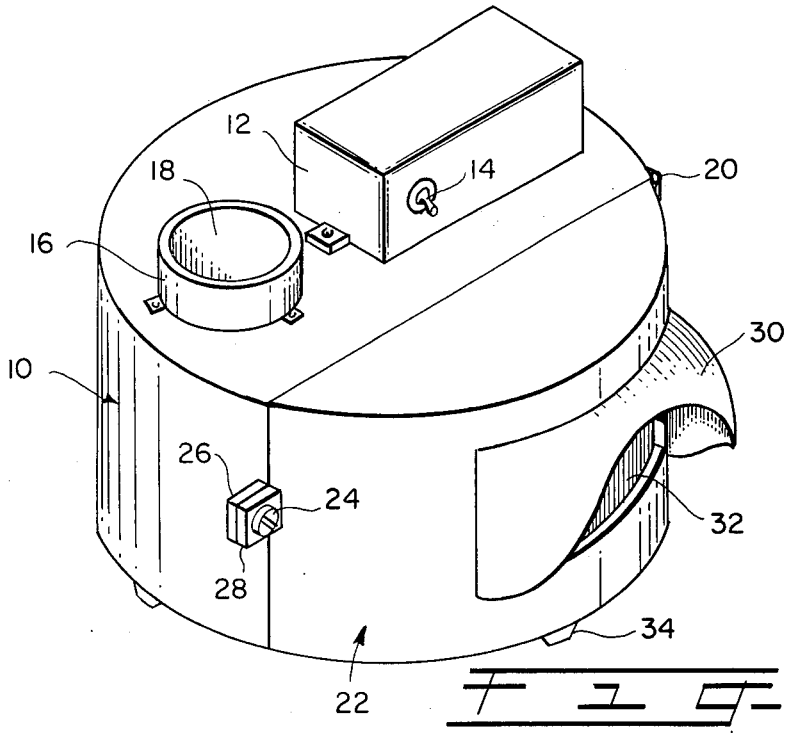
FIG. 1 is a perspective view of the shredding and slicing and dicing machine.

With regard to FIGS. 1, 2 and 3 a housing section 10 has mounted thereon a motor housing 12 which in turn has a switch 14 mounted thereon. A receptacle 16 mounted on the housing section 10 forms a cylindrical entry port 18 for admitting food to be chopped or shredded by the machine. A hinge 20 connects the housing section 10 to a second housing section 22 and the housing sections 10 and 22 are locked together by a nut and bolt 24 acting on a set of flanges 26 and 28. The second housing section 22 forms an opening flange 30 partially obscuring the exit opening 32 through which the chopped or shredded food particles exit. Rubber support feet 34 help keep the machine stationary and minimize any transmission of operating noises. A power cord 36 for powering an internally mounted motor may be seen in FIG. 2.

Figure 4:
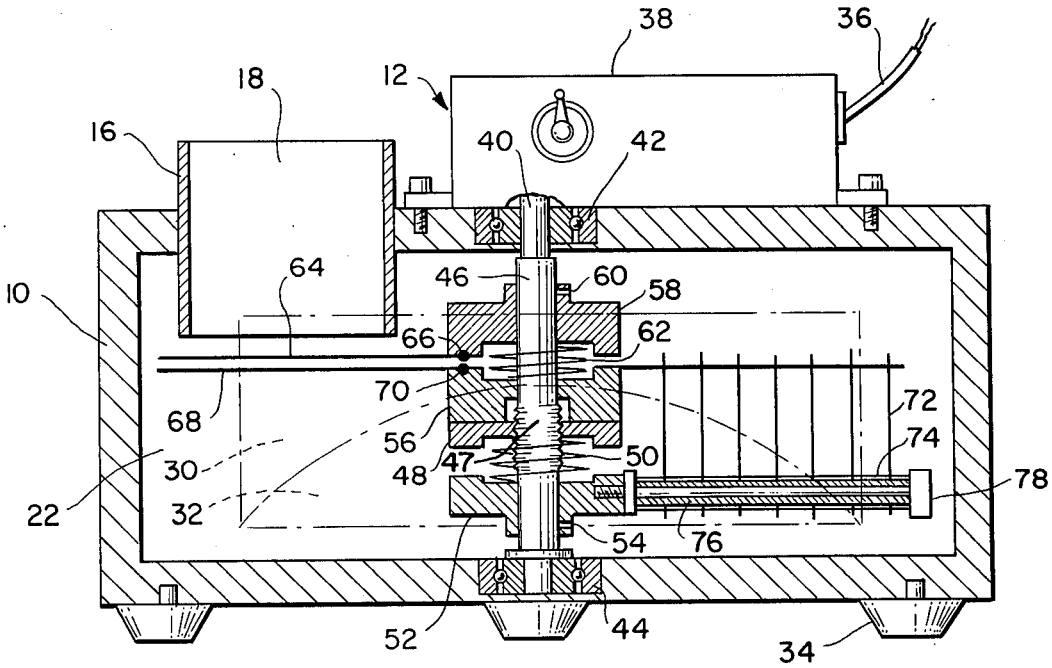
FIG. 4 is a cross sectional view of the slicing and dicing machine taken along the plane 4—4 of FIG. 2.

With regard to FIG. 4, on the housing 10 the motor housing 12 is seen with the switch 14 indicated in phantom and the motor 38 mounted in the motor housing 12. The motor is preferrably of the fractional horse power type and may be rated to operate at 1200 RPM. The power cord 36 is seen leading from the motor housing 12. A drive shaft 40 mounted in an upper bearing 42 and a lower bearing 44 forms a partially threaded enlargement 46 on the threaded portion 47 of which is mounted a threaded fly wheel 48. This fly wheel 48 is constrained upwardly by a spring 50 resting on a second fly wheel 52 also mounted on the drive shaft 46 and secured thereto by a set screw 54. A third fly wheel 56 is supported on the threaded fly wheel 48 and can be adjusted up and down by rotation of the threaded fly wheel 48.

A fourth fly wheel 58 is secured to the drive shaft 46 by a set screw 60. The fourth fly wheel 58 presses against a spring 62 to help position and hold down the third fly wheel 56. A parallel cutting blade 64 is secured by means of rivets 66 to the lower surface of the fourth fly wheel 58. A control disc 68 is secured to the upper surface of the third fly wheel 56 by means of rivets 70. A set of thin vertical cutting blades 72 passing through the control disc 68 are positioned by spacing sleeves 74 along the square rod 76 which is secured by threaded rod 78 to the second fly wheel 52. The receptical 16 can be seen forming the cylindrical entry port 18 through the housing section 10. When the switch 14 is turned on, the motor 38 will begin to operate and will reach an operating speed of 1200 RPM. This causes the control disc 68, the parallel cutting blade 64, and the assembly of the thin vertical blades 72 mounted on the square rod 76 to rotate. Food, then inserted into the entry port 18 will descend until it contacts the control disk 68 which rotates causing the vertical cutting blade 72 to slice the food and then causing the parallel cutting blade 64 to slice that section of food forming shreds. The rapid rotation of the control disk 68 drives the shredded food particles towards the oepning flange 30 seen partially in phantom in the wall of the second housing section 22 and forces the food particles to exit through the exit opening 32 where they may be received in a receiving vessel not disclosed in this application. The distance that the thin vertical cutting blades 72 penetrate through the control disc 68 determines the thickness of the shreds formed by the machine. This distance is determined by the position of the threaded fly wheel 48 which if it is raised produces thinner shreds and if it is lowered produces thicker shreds. If the thin vertical cutting blade assembly is removed then raising or lowering the control disc 68 will produce thinner or thicker slices of the food inserted through the entry port 18. The rubber support feet 34 stabilize the machine and prevent transmission of vibrations to a support, such as a table.

Figure 5:
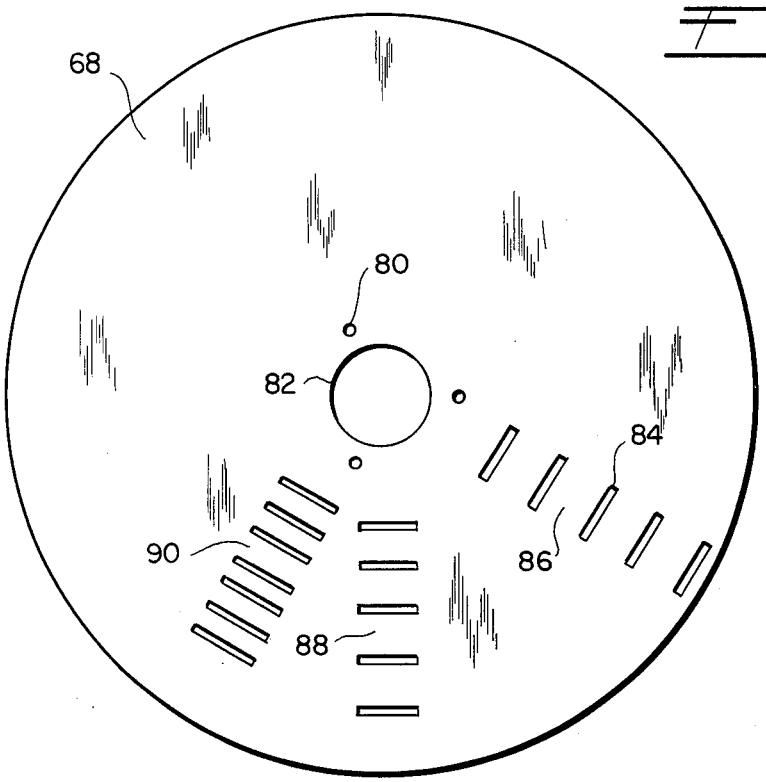
FIG. 5 is a top view of a control disc used in the slicing and dicing machine.

In FIG. 5, the control disc 68 is seen with holes 80 for the rivets 70 of FIG. 4. A central aperture 82 is provided in order to pass the control disk 68 over the upper smooth portion enlarged shaft 46 while the rivets 70 secure the disk to the fly wheel 56. A set of rows of narrow openings 84 is provided in the disk, by providing separate sets of openings with differing spacings between the openings 86, 88 and 90 food items can be shredded sliced into pieces that vary in thickness from thin to thick.

Figure 6:
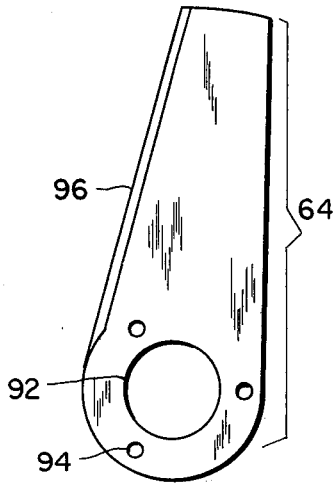
FIG. 6 is a top view of a parallel cutting blade used in the machine.

In FIG. 6, the parallel cutting blade, generally referred to by 64 forms a central aperture 92 to permit the parallel cutting blade to pass over the enlarged shaft 46 and the holes 94 formed around the central shaft 92 permit rivets 66 to attache the parallel cutting blade to fly wheel 58. The cutting edge 96 formed on a side of the parallel cutting blade 64 in rotating with the control disk will slice a section of the food material which is resting on the rotating control disk and will cut a slice of that material. If the thin vertical cutting blade 72 are mounted through the rows of narrow openings 84 in the control disk 68 then the parallel cutting blade 64 will form thin strips of the food material, the width and thickness of the strips depending on the spacing of the thin vertical cutting blades 72 and the spacing between the parallel cutting blade 64 and the control disk 68.

Figure 7:
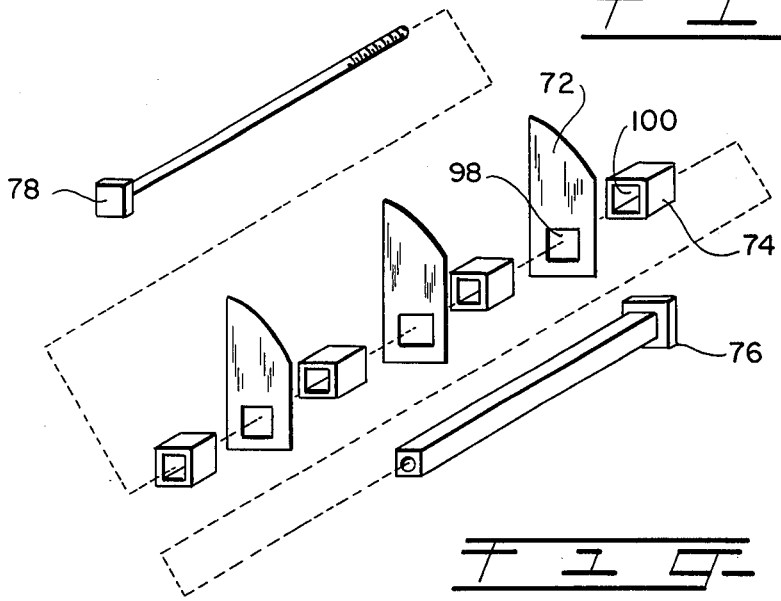
FIG. 7 is an exploded view of the thin vertical cutting blade assembly used in the machine.

In FIG. 7, the thin vertical cutting blades 72 each form central square apertures 98 for mounting on the square rod 76 and the cutting blades 72 are spaced by spacers 74 of suitable lengths based on the set of narrow openings 84 in the control disk 68 that is being used. Each spacer 74 forms a square aperture 100 for mounting the spacer 74 on the square rod 76. When the blade 72 and spacers 74 are mounted on the square rod 76 the assembly can be mounted on the fly wheel 52 by screwing in the threaded rod through the square rod 76 and securing the threaded rod in the fly wheel 52. The attachment of the vertical blade assembly to the fly wheel and the insertion of the thin vertical blades through the control disk provide a strength and rigidity which facilitates cutting of the food material and assists in providing a long service life for the unit.

It may thus be seen that the object set forth above may be attained from the preceeding description but since certain changes may be made in the above construction without departing from the spirit or scope of this invention it is intended that all matter contained in the above description and shown in the accompanying drawing shall be interpreted as illustrative and not in a limiting sense.

It is also to be understood that the following claims are intended to cover all the generic and specific features of the invention as herein described as well as any statements of the scope of the invention which may fall there between.

I claim:

1. A food dicing and shredding machine, comprising:
- a housing,
- a motor attached to the housing,
- a shaft extending vertically from the motor,
- a control disk vertically adjustably attached to the shaft,
- a parallel cutting blade attached to the shaft above the control disk,
- the shaft rotatably supported by the housing,
- means of introducing a piece of food through an upper surface of the housing down on to the control disk, and
- an exit opening formed in a side of the housing, whereby the piece of food may be sliced by the parallel cutting blade while resting on the control disk when the shaft is rotating and a piece sliced from the piece of food may be discharged through the exit opening.

2. The food shredding and dicing machine of claim 1, further comprising:
- the control disk forming a row of narrow openings in radial sequence through a face of the disk,
- a rod attached to the shaft below the control disk,
- a set of thin vertical cutting blades attached to the rod and each of the blades passing through one of the narrow openings in the control disk, and
- means of securably positioning each of the thin vertical blades on the rod below the control disk.

3. The food shredding and dicing machine of claim 2, wherein the means of securing the thin vertical blades to the rod comprises:
- each of the thin vertical blades forming a square aperture near a lower edge of the blade,
- a plurality of square spacing sleeves of a length equal to the space between each of the narrow openings in the control disk mounted between each of the thin vertical blades,
- a square rod mounted through the apertures in each of the thin vertical blades and through the apertures in each of the spacing sleeves,
- the square rod forming a shaftway through the length of the square rod, and
- a threaded rod insertable through the shaftway in the square rod and vertically secured to the shaft.

4. The shredding and dicing machine of claim 3, further comprising:
- a fly wheel attached to the shaft near a lower end of the shaft and the threaded rod threaded into an external edge of the fly wheel,
- a spring mounted on the fly wheel,
- a portion of the shaft above the fly wheel forming a male threaded surface,
- a second fly wheel forming a central female threaded opening threadingly secured to the threaded portion of the shaft and supported on the spring,
- a third fly wheel attached to the shaft above the second fly wheel and resting on the second fly wheel,
- the control disk attached to an upper surface of the third fly wheel,
- a spring attached to the shaft above the third fly wheel and resting on an upper surface of the third fly wheel,
- a fourth fly wheel fixedly attached to the shaft and pressing down in the second spring, and
- the parallel cutting blade fixedly attached to a lower surface of the fourth fly wheel.

5. The shredding and dicing machine of claim 1, wherein the means of introducing the food piece comprises:
- a round aperture formed in an upper surface of the housing, and
- a receptacle forming a cylindrical entry port mounted through the aperture in the upper surface of the housing and supporting the piece of food down to just above a path of the parallel cutting blade.

6. The shredding and dicing machine of claim 1, further comprising:
- an opening flange mounted over and around the exit opening, whereby a portion of the piece of food removed from the piece of food introduced into the machine may be directed downwards into a receiving vessel.

7. The shredding and dicing machine of claim 1, wherein the motor is mounted on an upper surface of the housing, and the shaft extends downward from the motor through the upper surface of the housing down to the lower surface of the housing, the shaft supported by an upper bearing mounted in the upper surface of the housing, and the shaft supported at a lower end of the shaft by another bearing mounted in the lower surface of the housing.

8. The shredding and dicing machine of claim 1, wherein the housing forms two sections which open laterally, connected by a hinge and closeable at another edge by a locking means, and a set of rubber support feet attached to a bottom surface of the housing, whereby the shredding and dicing machine may be mounted on a surface without transmitting vibrations to the surface.

* * * * *